US006811151B2

(12) United States Patent
Wei-Feng et al.

(10) Patent No.: US 6,811,151 B2
(45) Date of Patent: Nov. 2, 2004

(54) PAPER FEEDING APPARATUS AND DRIVING METHOD THEREOF FOR OFFICE MACHINE

(75) Inventors: Yen Wei-Feng, Taoyuan (TW); Yang Kun-Yee, Taoyuan (TW)

(73) Assignee: Benq Corporation, Taoyuan (TW)

( * ) Notice: Subject to any disclaimer, the term of this patent is extended or adjusted under 35 U.S.C. 154(b) by 47 days.

(21) Appl. No.: 10/256,087

(22) Filed: Sep. 26, 2002

(65) Prior Publication Data

US 2004/0021262 A1 Feb. 5, 2004

Related U.S. Application Data

(62) Division of application No. 09/630,001, filed on Jul. 31, 2000, now Pat. No. 6,485,011.

(30) Foreign Application Priority Data

Aug. 23, 1999 (TW) ..... 88114420

(51) Int. Cl.[7] ..... B65H 5/00

(52) U.S. Cl. ..... 271/10.03; 271/10.09; 271/10.11; 271/10.12; 271/242; 271/258.8

(58) Field of Search ..... 271/10.01, 10.03, 271/10.09, 10.11, 10.12, 242, 258.02, 265.01

(56) References Cited

U.S. PATENT DOCUMENTS

| | | | | |
|---|---|---|---|---|
| 4,798,374 A | | 1/1989 | Ito | |
| 4,846,456 A | | 7/1989 | Sakai | |
| 4,905,054 A | | 2/1990 | Rood | |
| 4,975,749 A | | 12/1990 | Tsunoda et al. | |
| 4,979,727 A | | 12/1990 | Koike et al. | |
| 4,984,779 A | | 1/1991 | Iwasaki | |
| 5,016,061 A | | 5/1991 | Tashiro et al. | |
| 5,054,768 A | | 10/1991 | Iseda | |
| 5,083,766 A | * | 1/1992 | Osawa | 271/121 |
| 5,228,669 A | | 7/1993 | Kanaya | |
| 5,296,908 A | | 3/1994 | Hatano et al. | |
| 5,308,054 A | | 5/1994 | Sugito | |
| 5,392,092 A | | 2/1995 | Laidlaw et al. | |
| 6,234,470 B1 | * | 5/2001 | Okitsu et al. | 271/114 |
| 6,354,584 B1 | | 3/2002 | Suga et al. | |
| 6,547,235 B2 | * | 4/2003 | Higaki | 271/10.01 |

* cited by examiner

*Primary Examiner*—Donald P. Walsh
*Assistant Examiner*—Kenneth W Bower
(74) *Attorney, Agent, or Firm*—Harness, Dickey & Pierce, PLC

(57) ABSTRACT

The invention is to provide a paper feeding apparatus and a driving method thereof for an office machine. The office machine includes a paper accommodating device and a paper processing apparatus. The paper accommodating device is for accommodating paper sheets to be processed by the paper processing apparatus. The paper feeding apparatus is for feeding the paper sheets accommodated by the paper accommodating device one by one to the paper processing apparatus. The paper feeding apparatus includes a pickup roller, a delivery roller, a pair of feeding rollers, a detection device, a transmission gear assembly, a drive motor and a controller. The detection device detects a leading edge and a trailing edge of the paper sheet delivered by the paper feeding apparatus. In particular, the paper feeding apparatus is a simple-configuration, light-weight and compact component and capable of feeding paper sheets accurately. During feeding operation of the paper feeding apparatus, the rollers of the paper feeding apparatus are driven rotating in respective direction or stopped rotating so as to feed the paper sheets accurately.

8 Claims, 3 Drawing Sheets

PAPER FEEDING APPARATUS AND DRIVING METHOD THEREOF FOR OFFICE MACHINE

CROSS-REFERENCE TO RELATED APPLICATIONS

This application is a divisional of U.S. patent application Ser. No. 09/630,001 filed on Jul. 31, 2000 now U.S. Pat. No. 6,485,001. The disclosure of the above application is incorporated herein by reference.

FIELD OF THE INVENTION

The present invention relates to a paper feeding apparatus and a driving method thereof for an office machine, such as a printer, a copy machine, a scanner, a fax, a multi-function office machine or an all-in-one office machine.

BACKGROUND OF THE INVENTION

An office machine inevitably requires a paper feeding apparatus for feeding paper sheets to be processed by the office machine. The related prior arts refer to the following: U.S. Pat. Nos. 5,392,092; 5,296,908; 4,798,374; 4,975,749; 4,984,779; 5,016,061; 4,846,456; 5,054,768; 4,905,054; 4,979,727; and 5,228,669.

A typical paper feeding apparatus of an office machine must meet the needs of feeding the paper sheets accurately. The paper feeding apparatus should feed the paper sheets in order, such that a misfeed or a double feed of the paper sheets does not take place. Moreover, the leading edge of the delivered paper sheet should be well aligned so that distortion of the sheet does not occur during the process performed by the office machine.

The current. design for office machines gravitate towards the desk-top type, multi-function and even all-in-one design in order to increase usefulness and portability. The so-called multi-function or all-in-one office machine combines the functions of various office equipments into one. Obviously, the current office machine still requires simple-configuration, light-weight and compact components to reduce weight of the machine and space occupied by the machine. Accordingly, an objective of the invention is to provide a simple-configuration, light-weight and compact paper feeding apparatus for an office machine. Moreover, the paper feeding apparatus feeds paper sheets into the office machine accurately.

In addition, another objective of the invention is to provide a method for driving such simple-configuration, light-weight and compact paper feeding apparatus. Moreover, the method can drive the paper feeding apparatus feeding paper sheets into the office machine accurately.

SUMMARY OF THE INVENTION

The objective of the invention is to provide a paper feeding apparatus for an office machine. The office machine includes a paper accommodating device and a paper processing apparatus. The paper accommodating device accommodates paper sheets to be processed by the paper processing apparatus. The paper feeding apparatus feeds the paper sheets accommodated by the paper accommodating device one by one to the paper processing apparatus. In particular, the paper feeding apparatus is simple-configuration, light-weight and compact, and feeds paper sheets into the office machine accurately.

According to a preferred embodiment of the invention, the paper feeding apparatus includes a pickup roller, a delivery roller, a pair of feeding rollers, a detection device and a driving device. The detection device detects a leading edge and a trailing edge of the paper sheet delivered by the paper feeding apparatus. The pickup roller selectively picks up an uppermost sheet of the paper sheets accommodated by the paper accommodating device. The delivery roller delivers the paper sheet picked up by the pickup roller. The feeding rollers selectively blocks delivery of the paper sheet, or selectively delivering the paper sheet delivered from the delivery roller to the paper processing apparatus. The detection device detects a leading edge and a trailing edge of the paper sheet being delivered by the paper feeding apparatus. The driving device, in response to the result detected by the detection device, selectively drives the rotation of the pick roller, delivery roller and feeding rollers.

Another objective of the invention is to provide a driving method for driving such paper feeding apparatus so as to feeding paper sheets by the paper feeding apparatus into the office machine accurately.

According to the driving method, while the feeding apparatus starts picking up and feeding the paper sheets, the driving device drives the pickup roller rotating in a first direction to pick up the uppermost sheet of the paper sheets accommodated by the paper accommodating device, drives the delivery roller rotating in the first direction to deliver the paper sheet delivered from the pickup roller, and drives an active roller of the feeding rollers rotating in a second direction, opposite to the first direction, to block the paper sheet delivered from the delivery roller. While the leading edge of the paper sheet delivered through the paper feeding apparatus. is located between the delivery roller and the feeding rollers, after a delay of short period of time, the driving device stops driving the pickup roller, drives the delivery roller rotating in the first direction still, and drives the active roller rotating in the first direction to deliver the paper sheet delivered from the delivery roller to the paper processing apparatus.

The advantage and spirit of the invention may be understood by the following recitations together with the appended drawings.

BRIEF DESCRIPTION OF THE APPENDED DRAWINGS

FIG. 1A shows an office machine 10 employing a paper feeding apparatus 20 according to a preferred embodiment of the invention while the roller 21 is operated in a clockwise direction, and the roller 23 rotates in counter-clockwise direction.

FIG. 1B shows the office machine 10 in FIG. 1A while roller 22 rotates in clockwise direction and the roller 23 rotates in clockwise direction.

DETAILED DESCRIPTION OF THE INVENTION

Figure 1A:
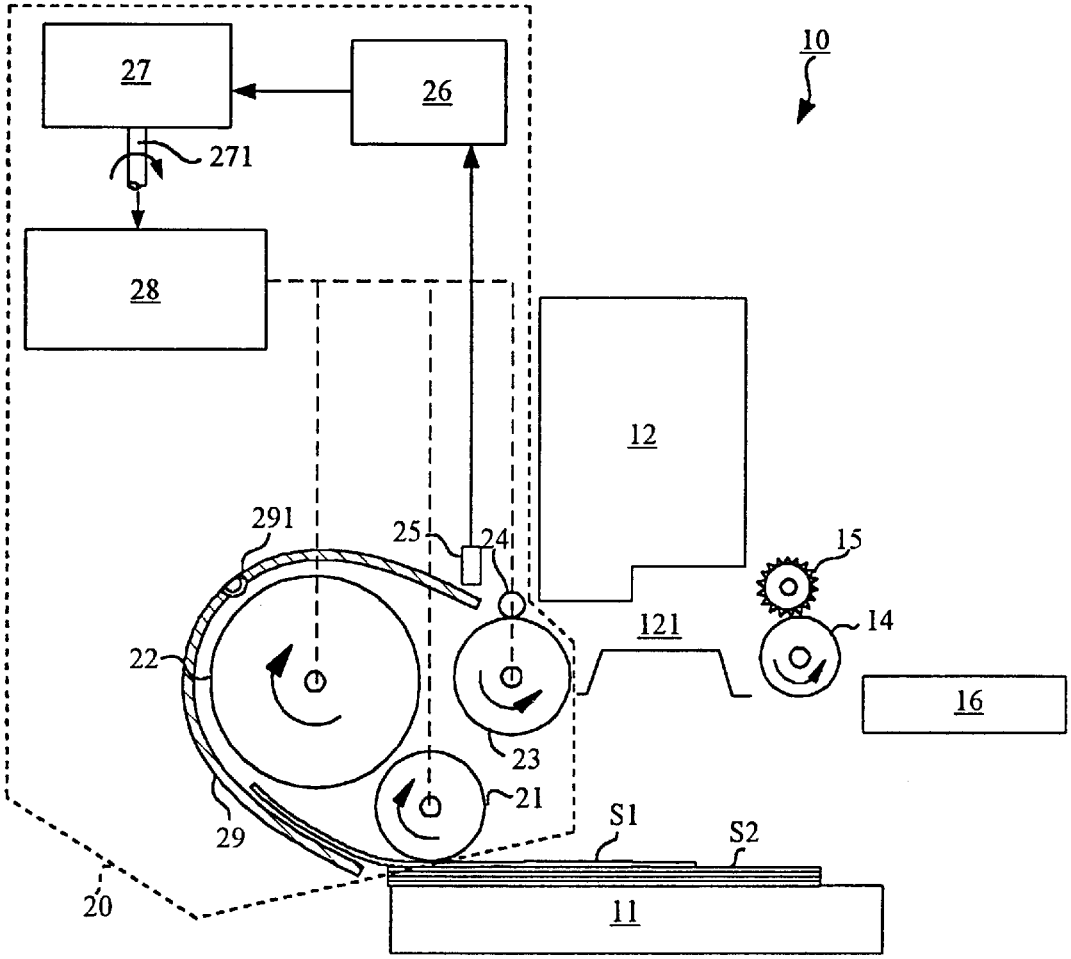
Figure 1B:
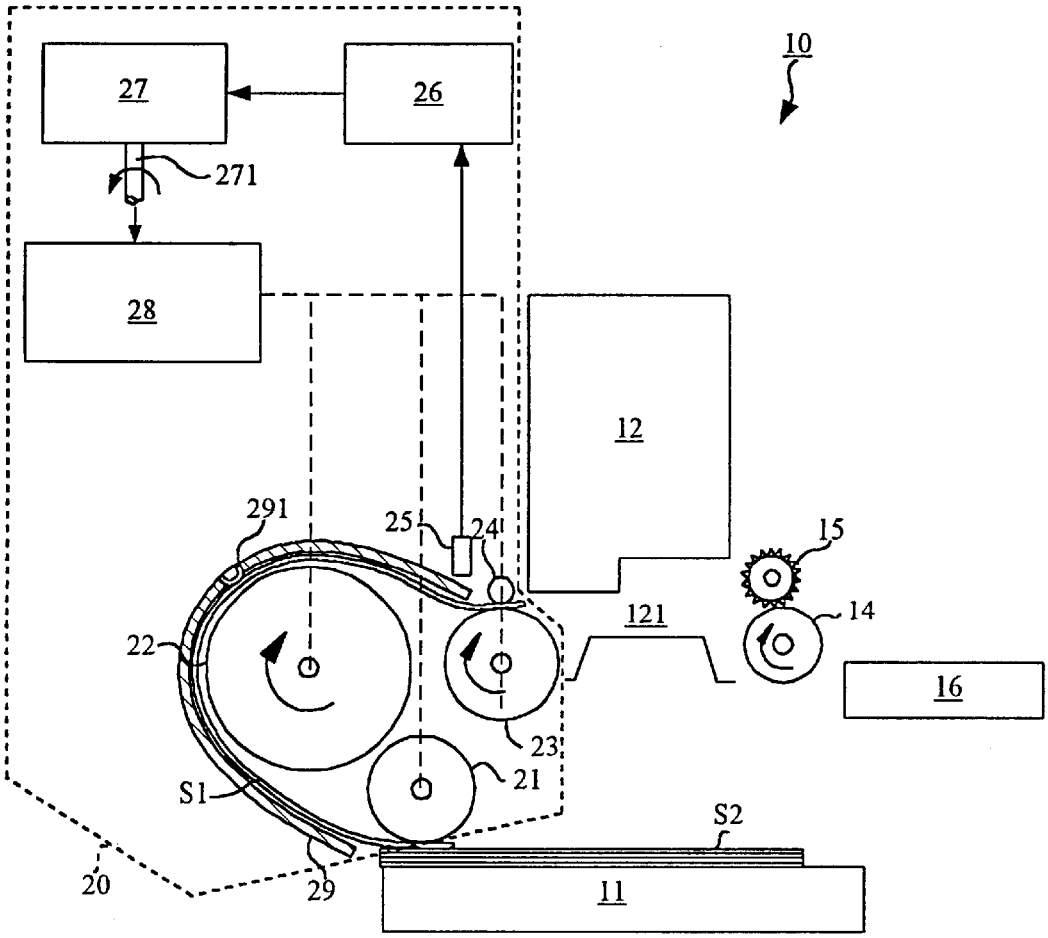

Referring to FIGS. 1A and 1B, a paper feeding apparatus 20 is provided for use in an office machine 10. The office machine 10 may be a printer, a copy machine, a scanner, a fax, a multi-function office machine or an all-in-one office machine. The rotation directions of rollers in the paper feeding apparatus 20 during paper feeding operation are shown in FIGS. 1A and 1B.

As shown in FIGS. 1A and 1B, the office machine 10 includes an initial tray 11, a paper processing apparatus 12, a pair of discharge rollers 14, 15 and a finish tray 16. The initial tray 11 accommodates paper sheets to be processed by the paper processing apparatus 12. The paper processing apparatus 12 performs a predetermined process on the paper sheets delivered therein, e.g. duplicating or reading information on the paper sheets. The paper feeding apparatus 20 feeds the paper sheets accommodated by the initial tray 11 one by one into a processing path 121. Within the processing path 121, the components of the paper processing apparatus 12 respectively perform specific operations over the paper sheets. After being processed, each paper sheet is discharged by the discharge roller 14, 15 to the finish tray 16.

The paper feeding apparatus 20 includes a pickup roller 21, a delivery roller 22, a pair of feeding rollers, a detection device 25, a controller 26, a drive motor 27, a transmission gear assembly 28 and a guide board 29. The pair of feeding rollers include an active roller 23 and an idle roller 24.

The detection device 25 generates signals indicating the arrival of the leading edge and the departure of trailing edge of the paper sheet delivered by the paper feeding apparatus 20. The detection device 25 could be a micro switch. During the period of delivering one sheet of paper, the leading edge of the sheet first approaches and triggers the detection device 25. Then, the trailing edge of the sheet leaves and releases the detection device 25. In other words, the detection device 25 detects the leading edge and trailing edge of the paper sheets delivered easily and accurately.

In this embodiment, the detection device 25 is a micro switch, and the micro switch is disposed between the delivery roller 22 and the pair of feeding rollers (23 and 24).

The pickup roller 21 selectively picks up and delivers an uppermost sheet S1 of the paper sheets accommodated by the initial tray 11. The delivery roller 22, cooperating with the guide board 29, delivers the paper sheet delivered from the pickup roller 21. As shown, the delivery direction of the paper sheets delivered through the delivery roller 22 and the guide board 29 is rerouted to a direction opposite to the original direction. Obviously, this design reduces the space occupied by the office machine 10. To help re-route the delivery direction of the delivered paper sheet S1 passing the guide board 29, a follow roller 291 is provided at a suitable location of the guide board 29 to assist the delivered paper sheet to adjust its delivery direction. Responsive to the detection result generated by the detection device 25, the active roller 23 and idle roller 24 selectively block the delivery of the sheet delivered to align the leading edge of the sheet when the leading edge of the sheet contacting the active roller 23 and idle roller 24, or selectively deliver the sheet into the processing path 121.

The controller 26 is electrically connected to the detection device 25 and receives the signals generated by the detection device 25. The controller 26 is also electrically connected to the drive motor 27 and controls the operation of the drive motor 27 in response to the signals generated by the detection device 25. The drive motor 27 drives the transmission gear assembly 28 via the transmission shaft 271. The transmission gear assembly 28 is operatively connected to the pickup roller 21, the delivery roller 22 and the active roller 23 and the idle roller 24 for selectively controlling the rotation of the respective rollers 21, 22, 23 and 24. The controller 26, the drive motor 27 and the transmission gear assembly 28 constitute a driving device for selectively driving the rotation of the rollers in the paper feeding apparatus 20 in response to the result detected by the detection device 25. According to this embodiment, the drive motor 27 could be a bi-directional drive motor.

The rotation of the pickup roller 21, the delivery roller 22 and the active roller 23 driven by the driving device includes the following operation conditions.

1. While the paper feeding apparatus 20 starts picking up and feeding the uppermost sheet S1 of the paper sheet, and before the detection device 25 generates signal indicating the arrival of the leading edge of the sheet S1, the driving device drives the pickup roller 21 to rotate in a first direction (a clockwise direction indicated in FIG. 1A) to pick up the uppermost sheet S1, drives the delivery roller 22 to rotate in the first direction to deliver the paper sheet S1 delivered from the pickup roller 21, and drives the active roller 23 to rotate in a second direction (a counterclockwise direction indicated in FIG. 1A), opposite to the first direction, to temporarily block the sheet S1 delivered from the delivery roller 22 so as to align the leading edge of the sheet S1 across the span of the sheet S1.
2. As the detection device 25 generates signals indicating the arrival of the leading edge of the sheet S1, as shown in FIG. 1B, the driving device, after a delay of short period of time, stops driving the pickup roller 21 while driving the delivery roller 22 to rotate in the first direction, and drives the active roller 23 to rotate in the first direction to deliver the sheet S1 into the processing path 121.
3. As the detection device 25 generates signals indicating the departure of the trailing edge of the paper sheet S1, the driving device, after a delay of short period of time, drives the pickup roller 21 to rotate in the first direction to pick up another uppermost sheet S2, drives the delivery roller 22 to rotate in the first direction, and drives the active roller 23 to rotate in the second direction.

Also shown in FIGS. 1A and 1B, the discharge rollers include an active roller 14 and an idle roller 15. During the discharging operation of the sheet, the active roller 14 is first driven to rotate in the second direction (the counterclockwise direction indicated in FIG. 1A) to align the leading edge of the sheet across the span of the sheet, and then is driven to rotate in the first direction (the clockwise direction as indicated in FIG. 1B) to discharge the sheet to the finish tray 16.

It is apparent that the configuration of the paper feeding apparatus 20 of the invention is simpler than the prior arts. According to this embodiment, the paper feeding apparatus 20 feeds paper sheets accurately by using a number of components including the rollers 21, 22, 23 and 24, detection device 25, controller 26, drive motor 27 and transmission gear assembly 28. To further reduce the entire weight and space occupied of the office machine 10, a simplified transmission gear assembly 28 is provided and will be described in detail hereinafter.

Figure 2A:
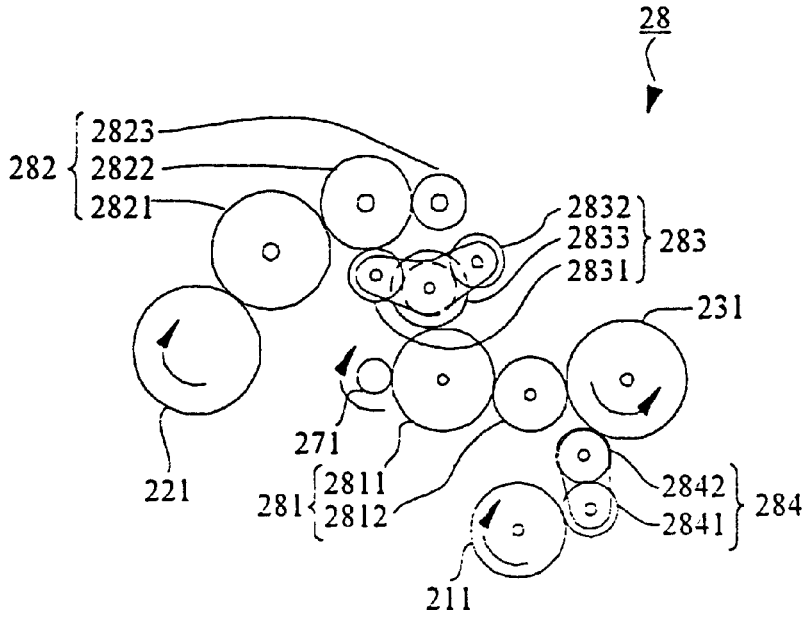
FIG. 2A shows a preferred embodiment of the transmission gear assembly 28 while the transmission shaft 271 rotates in clockwise direction.
Figure 2B:
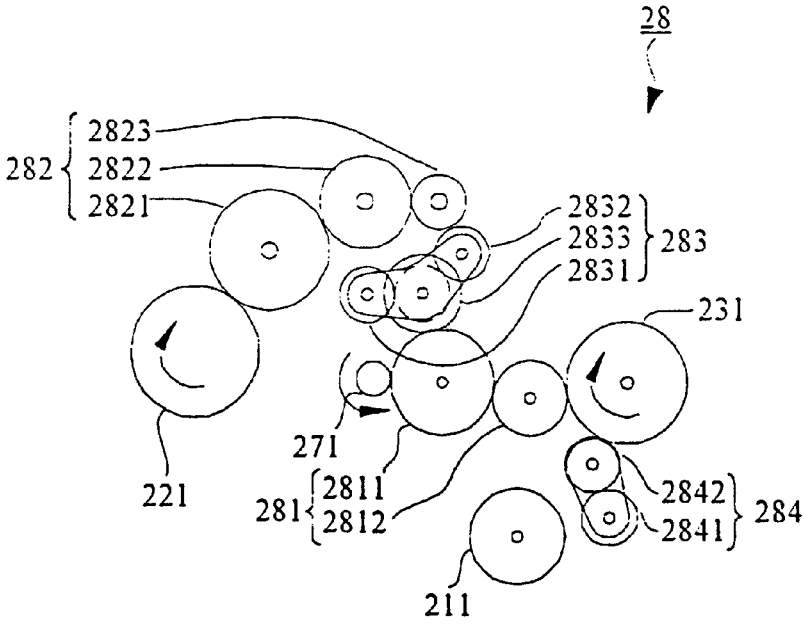
FIG. 2B show the transmission gear assembly 28 in FIG. 2A while the transmission shaft 271 rotates in counter-clockwise direction.

Referring to FIGS. 2A and 2B, an preferred embodiment of the transmission gear assembly 28 is shown to include a first driving gear 211, a second driving gear 221, a third driving gear 231, a first gear set 281, a second gear set 282, a first planetary gear set 283 and a second planetary gear set 284. Not shown in FIGS. 2A and 2B, the pickup roller 21 is driven by the first driving gear 211, the delivery roller 22 is driven by the second driving gear 221, the active roller 23 is driven by the third driving gear 231. The first gear set 281 includes an even number of gears 2811, 2812, the second gear set 282 includes an odd number of gears 2823, 2822, 2821. The first planetary gear set 283 includes gears 2832,

2833, 2831 and the second planetary gear set 284 includes gears 2842, 2841.

As shown in FIGS. 2A and 2B, the first end gear 2811 meshes with the transmission shaft 271. The second end gear 2812 meshes with the third driving gear 231. The first end gear 2821 meshes with the second driving gear 221 and the middle gear 2822. It is required in this embodiment that an odd number of gears be disposed between the second driving gear 221 and the middle gear 2822. For instance, there is one gear disposed between the driving gear 221 and the middle gear 2822 in FIGS. 2A and 2B.

The first end gear 2831 selectively meshes with the middle gear 2822. The second end gear 2832 selectively meshes with the second end gear 2823. The middle gear 2833 meshes with the first end gear 2811. It is required that an odd number of gears be disposed between the transmission shaft 271 and the middle gear 2833 so that the middle gear 2833 and the transmission shaft 271 rotate in the same direction. In the preferred embodiment shown in FIGS. 2A and 2B, one gear 2811 is disposed between the transmission shaft 271 and the middle gear 2833. The first end gear 2841 selectively meshes with the first driving gear 211.

In the preferred embodiment of the invention shown in FIGS. 2A and 2B, the second end gear 2842 meshes with the third driving gear 231 so that the second end gear 2842 and the transmission shaft 271 rotate in the same direction.

In another preferred embodiment of the invention (not shown), the second end gear 2842 meshes with the driving gear 231 while there are an odd number of gears between the second end gear 2842 and the transmission shaft 271. In this way, the second end gear 2842 and the transmission shaft 271 rotate in the same direction.

Through the above-mentioned arrangement the gears in the transmission gear assembly 28, it is apparent that as the transmission shaft 271 is driven in the first direction, the pickup roller 21 and the delivery roller 22 are driven in the first direction, and the active roller 23 is driven in the second direction. As the transmission shaft 271 is driven in the second direction, the pickup roller 21 stops rotating, the delivery roller 22 and the active roller 23 are driven in the first direction.

Alternatively, there are a belt or an odd number of gears provided between the active roller 14 and the active roller 23 to ensure that the active roller 14 and the active roller 23 are driven in the same direction.

As a summary, the driving method provided to drive the paper feeding apparatus 20 includes the following steps.

1. As the feeding apparatus 20 starts picking up and feeding the paper sheet, and before the detection device 25 generates signals indicating the arrival of the leading edge of the paper sheet, the controller 26 drives the transmission shaft 271 rotating in the first direction. So that the pickup roller 21 rotates in the first direction to pick up the uppermost sheet S1, the delivery roller 22 rotates in the first direction to deliver the paper sheet delivered from the pickup roller 21, and the active roller 23 rotates in a second direction to temporarily block the delivery of the paper sheet so as to align the leading edge of the paper sheet.
2. As the detection device 25 generates signals indicating the arrival of the leading edge of the paper sheet, after a delay of short period of time during which the alignment of the leading edge of the paper sheet is accomplished, the controller 26 drives the transmission shaft 271 to rotate in the second direction. So that the pickup roller 21 stops rotating while the delivery roller 22 rotates in the first direction and the active roller 23 rotates in the first direction to deliver the paper sheet to the paper processing apparatus 12.
3. As the detection device 25 generates signals indicating the departure of the trailing edge of the paper sheet, after a delay of short period of time, the controller 26 drives the transmission shaft 271 to rotate in the first direction. So that the pickup roller 21 rotates in the first direction to pick up another paper sheet disposed uppermost on the paper sheets while the delivery roller 22 rotates in the first direction and the active roller 23 rotates in the second direction.

The above details of the preferred embodiments of the aforesaid invention are illustrative rather than limiting. For instance, the gear sets and planetary gear sets according to the invention may be replaced equivalently by other forms which are obvious to persons skillful in the arts. Accordingly, any equivalent modifications, substitutes, alterations or changes to the preferred embodiment without departing form the spirit of the invention are likely to persons with ordinary skills in the arts, and are still within the intended scope of the protection of the invention.

What is claimed is:

1. A method for driving a paper feeding apparatus, said paper feeding apparatus feeding a paper to a paper processing apparatus, the paper feeding apparatus comprising a pickup roller for selectively retrieving the paper, a delivery roller for delivering the paper delivered from the pickup roller, an active roller for selectively blocking or delivering the paper delivered from the delivery roller to the paper processing apparatus, and a driving device for selectively rotating the pickup roller, the delivery roller and the active roller, said method comprising the steps of:

while the feeding apparatus starts feeding the paper, the driving device rotating the pickup roller to retrieve the paper, driving the delivery roller to rotate in a first direction to deliver the paper delivered from the pickup roller, and driving the active roller to rotate in a second direction, which is opposite to the first direction, to block the paper delivered from the delivery roller;

while a leading edge of the paper delivered through the paper feeding apparatus is located between the delivery roller and the active roller, the driving device, after a delay of a first predetermined time period, stopping driving the pickup roller, driving the delivery roller to rotate in the first direction still, and driving the active roller to rotate in the first direction to deliver the paper to the paper processing apparatus.

2. The method of claim 1, the paper feeding apparatus further comprising a detection device disposed between the delivery roller and the active roller for detecting the leading edge of the paper, wherein the steps of driving the paper feeding apparatus are performed according to a signal generated by the detection device indicating the arrival of the leading edge of the paper; and:

while the feeding apparatus starts feeding the paper, and before the leading edge of the paper triggers the detection device, the pickup roller and delivery roller are driven to rotate in the first direction, and the active roller is driven to rotate in the second direction;

while the leading edge of the paper triggers the detection device, after a delay of the first predetermined time period, the delivery roller and active roller are driven to rotate in the first direction.

3. The method of claims 2, wherein the detection device further detecting a trailing edge of the paper, and the method further comprising the step of:

while the trailing edge of the paper is located between the delivery roller and the active roller, the driving device, after a delay of a second predetermined time period, driving the pickup roller to rotate to retrieve another paper, driving the delivery roller to rotate in the first direction, and driving the active roller to rotate in the second direction.

4. The method of claim 2, the pickup roller, the delivery roller and the active roller at one end thereof being provided with a driving gear, respectively, the driving device comprising:

a transmission gear assembly operatively connected to the pickup roller, the transmission gear assembly comprising:

a first gear set, consisting of an even number of gears, including a first end gear substantially meshed with the transmission shaft and a second end gear substantially meshed with the driven gear of the active roller;

a second gear set, consisting of an odd number of gears, including a first end gear substantially meshed with the driving gear of the delivery roller, a middle gear and a second end gear, wherein there are an odd number of gears disposed between the driving gear of the delivery roller and the middle gear of the second gear set;

a first planetary gear set including a first end gear selectively meshed with the middle gear of the second gear set, a second end gear selectively meshed with the second end gear of the second gear set, and a middle gear substantially meshed with one of the gears of the first gear set, wherein there are an odd number of gears disposed between the transmission shaft and the middle gear of the first planetary gear set;

a second planetary gear set including a first end gear selectively meshed with the driving gear of the pickup roller and a second end gear substantially meshed with one of the gears of the first gear set and the driving gear of the active roller, wherein there are an odd number of gears disposed between the transmission shaft and the second end gear of the second planetary gear set;

a drive motor operatively connected to the transmission gear assembly for transferring power to the transmission gear assembly;

a controller for control operation of the drive motor;

a transmission gear assembly for selectively driving the rotation of the rollers in the paper feeding apparatus, the operation of the transmission gear assembly being driven by the drive motor;

wherein the step of driving the active roller and delivery roller to rotate in the first direction and driving the active roller to rotate in the second direction is performed by driving the transmission shaft to rotate in the first direction, the step of stopping driving the pickup roller and driving the delivery roller and active roller to rotate in the first direction is performed by driving the transmission shaft to rotate in the second direction.

5. A method for driving a paper feeding apparatus, said paper feeding apparatus feeding a paper to a paper processing apparatus, the paper feeding apparatus comprising a pickup roller for retrieving the paper, a delivery roller for delivering the paper delivered from the pickup roller, an active roller for selectively blocking or delivering the paper delivered from the delivery roller, and a driving device for selectively rotating the pickup roller, the delivery roller and the active roller, said method comprising the steps of:

while the feeding apparatus starts feeding the paper, the driving device rotating the pickup roller to retrieve the paper, driving the delivery roller to rotate in a first direction to generate a delivery force to deliver the paper delivered from the delivery roller, and driving the active roller to rotate in a second direction to generate a blocking force which is opposite to the delivery force, to block the paper delivered from the delivery roller;

while a leading edge of paper is located between the delivery roller and the active roller, the driving device, after a delay of a first predetermined time period, stopping driving the pickup roller, driving the delivery roller to rotate in the first direction still, and driving the active roller to rotate in a third direction which is opposite to the second direction, to deliver the paper delivered from the delivery roller to the paper processing apparatus.

6. A method according to claim 5, wherein the second direction is substantially opposite to the first direction, and wherein the third direction is the same as the first direction.

7. The method of claim 5, the paper feeding apparatus further comprising a detection device disposed between the delivery roller and the active roller for detecting the leading edge of the paper delivered through the paper feeding apparatus, wherein the steps of driving the paper feeding apparatus are performed according to a signal generated by the detection device indicating the arrival of the leading edge of the paper; and:

while the feeding apparatus starts feeding the paper, and before the leading edge of the paper triggers the detection device, the delivery roller are driven to rotate in the first direction, and the active roller is driven to rotate in the second direction; while the leading edge of the paper triggers the detection device, after a delay of the first predetermined time period, the delivery roller is driven to rotate in the first direction and the active roller is driven to rotate in the third direction.

8. The method of claim 7, wherein the detection device further detecting a trailing edge of the paper, and the method further comprising the step of: while the trailing edge of the paper delivered through the paper feeding apparatus is located between the delivery roller and the active roller, the driving device, after a delay of a second predetermined time period, driving the pickup roller to rotate to retrieve another paper, driving the delivery roller to rotate in the first direction, and driving the active roller to rotate in the second direction.

* * * * *